US008678382B2

(12) United States Patent
Deno

(10) Patent No.: US 8,678,382 B2
(45) Date of Patent: Mar. 25, 2014

(54) SHEET CONVEYANCE APPARATUS AND IMAGE FORMING APPARATUS

(71) Applicant: Canon Kabushiki Kaisha, Tokyo (JP)

(72) Inventor: Kouhei Deno, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/869,860

(22) Filed: Apr. 24, 2013

(65) Prior Publication Data

US 2013/0285316 A1 Oct. 31, 2013

(30) Foreign Application Priority Data

Apr. 27, 2012 (JP) ..... 2012-102481

(51) Int. Cl.
*B65H 9/04* (2006.01)

(52) U.S. Cl.
USPC ..... 271/242; 271/228; 271/273

(58) Field of Classification Search
USPC ..... 271/228, 242, 273, 274, 252, 226, 902; 399/394, 395
See application file for complete search history.

(56) References Cited

U.S. PATENT DOCUMENTS

| | | | | |
|---|---|---|---|---|
| 2,974,952 | A * | 3/1961 | Zeuthen | 271/242 |
| 6,585,439 | B2 * | 7/2003 | Johnson et al. | 400/642 |
| 7,219,888 | B2 * | 5/2007 | Trovinger et al. | 271/227 |
| 7,946,776 | B2 * | 5/2011 | Sonoda | 400/636 |
| 8,091,890 | B2 * | 1/2012 | Yanagishita | 271/273 |
| 8,393,618 | B2 * | 3/2013 | Nakada et al. | 271/227 |
| 8,419,013 | B2 * | 4/2013 | Muneyasu et al. | 271/246 |

FOREIGN PATENT DOCUMENTS

| | | |
|---|---|---|
| JP | 6-127753 A | 5/1994 |
| JP | 4016621 B2 | 12/2007 |

* cited by examiner

*Primary Examiner* — Jeremy R Severson
(74) *Attorney, Agent, or Firm* — Canon U.S.A., Inc., IP Division

(57) ABSTRACT

A sheet conveyance apparatus includes a conveyance roller pair, a conveyance roller driving unit, a registration roller pair, a registration driving unit, a separation and press-contact unit configured to set the registration roller pair to a separated state and to a press-contact state, and a control unit. After a sheet has stopped at a stop position immediately before the registration roller pair, the registration roller pair having been set to the separated state is set to the press-contact state. The registration roller pair is rotated backward during formation of a loop in the sheet.

13 Claims, 10 Drawing Sheets

SHEET CONVEYANCE APPARATUS AND IMAGE FORMING APPARATUS

BACKGROUND

1. Field

Aspects of the present invention generally relate to a sheet conveyance apparatus that corrects skewing of a sheet, and an image forming apparatus that includes the sheet conveyance apparatus.

2. Description of the Related Art

A conventional image forming apparatus for forming an image on a sheet includes, in order to form an image on a sheet without any inclination, a skew correction device that corrects skewing of a sheet fed to an image forming unit.

Japanese Patent No. 4016621 discusses a skew correction device that corrects skewing of the leading edge of a sheet by causing the leading edge of the sheet conveyed by an upper roller pair disposed upstream of a registration roller pair to contact the nip portion of the registration roller pair and forming a loop on the sheet.

Japanese Patent Application Laid-Open No. 6-127753 discusses a skew correction device that corrects skewing by stopping a sheet conveyed by an upstream roller pair at an upstream stop position of the nip portion of a registration roller pair, resuming rotation of the upstream roller pair after a predetermined time has elapsed, conveying the sheet to the nip portion of the registration roller pair at a low speed, and forming a loop. According to the skew correction device discussed in Japanese Patent Application Laid-Open No. 6-127753, a sound or damage of the leading edge of the sheet generated or caused when the leading edge of the sheet fed by the upstream roller pair hits the nip portion of the registration roller pair can be reduced. In addition, the conventional skew correction devices include a type that has a function of setting the registration roller pair to a separated state and a press-contact state after the sheet, which is conveyed to the downstream side by the registration roller pair, has reached a transfer unit. This is because sheet conveyance during image transfer at an image forming unit needs to be carried out more accurately to improve image formation on the sheet. It is desirable to transfer an image while the sheet is conveyed only by a transfer roller instead of transferring an image while the sheet is nipped and conveyed by a plurality of rollers. There is also a type configured to correct positional deviation of the sheet in a width direction by moving the registration roller pair in the width direction of the sheet. The registration roller pair is moved to a home position while the registration roller pair is set to the separated state.

However, there is room for improvements of the conventional skew correction devices.

To reduce a sound or damage generated or caused when the leading edge of the sheet hits the nip portion of the registration roller pair, as in the case of the configuration discussed in Japanese Patent Application Laid-Open No. 6-127753, it is desirable that the sheet is stopped at a stop position upstream of the nip portion of the registration roller pair. In view of sheet productivity, the stop position of the sheet is desirably to be the position immediately before the nip portion of the registration roller pair.

To more accurately convey the sheet during the image transfer, the registration roller pair is desirably set to the separated state after the sheet has reached the transfer unit.

The following problems occur in the configuration where both the operation of stopping the sheet immediately before the nip portion of the registration roller pair and the operation of setting the registration roller pair to the separated state and the press-contact state are carried out.

For the registration roller pair set to the separated state after a preceding sheet has reached the transfer unit, a press-contact operation needs to be completed before the leading edge of a succeeding sheet contacts the nip portion of the registration roller pair. In a recent image forming apparatus, a sheet conveyance speed has become faster to improve productivity, and an interval between the preceding sheet and the succeeding sheet has become shorter. On the other hand, there is a limit to a speed (time) for setting the registration roller pair to the press-contact state.

Thus, in the configuration where both the operation of setting the registration roller pair to the separated state and the press-contact state and the operation of stopping the sheet immediately before the nip portion of the registration roller pair are carried out, the registration roller pair is set to a press-contact state after the succeeding sheet has reached the stop position and stopped at that position. Since the stop position of the succeeding sheet is immediately before the nip portion of the registration roller pair, if the skewing amount of the succeeding sheet is large, the leading edge of the succeeding sheet may be nipped.

Once the leading edge of the succeeding sheet has been nipped, the leading edge of the sheet cannot hit the nip portion of the registration roller pair to be aligned even if the upstream roller pair resumes its rotation to convey the sheet. This greatly deteriorates sheet skew correction performance. The deteriorated sheet skew correction performance causes formation of a defective image because the image cannot be formed in a normal position of the sheet.

The stop position of the sheet may be set at a position more upstream in the sheet conveying direction in view of a maximum skewing amount of the sheet so that the registration roller pair cannot nip the leading edge of the sheet reaching the stop position when the registration roller pair is set to the press-contact state. However, when the stop position is set more upstream in the conveying direction, much time is necessary for operations to resume the rotation of the upstream roller pair, convey the sheet at a low speed, and form a loop, consequently lowering productivity.

SUMMARY OF THE INVENTION

An aspect of the present invention is generally related to a sheet conveyance apparatus in which productivity and skew correction performance are improved in a configuration thereof where a registration roller pair is set to a separated state, to convey a sheet during image transfer with higher accuracy.

According to an aspect of the present invention, a sheet conveyance apparatus includes a conveyance roller pair configured to nip and convey a sheet, a conveyance roller driving unit configured to drive the conveyance roller pair, a registration roller pair disposed downstream of the conveyance roller pair and configured to nip and convey the sheet to a transfer unit, a registration driving unit configured to drive the registration roller pair to rotate forward and backward, wherein the registration driving unit rotates the registration roller pair forward to convey the sheet downstream in a conveying direction, and rotates the registration roller pair backward to convey the sheet upstream in the conveying direction, a separation and press-contact unit configured to set the registration roller pair to a separated state and to a press-contact state, and a control unit configured to control the conveyance roller driving unit, the registration driving unit, and the separation and press-contact unit. The control unit sets the registration roller pair to the separated state after a leading edge of a preceding sheet conveyed downstream in the conveying direction by the registration roller pair has reached the transfer unit. The control unit stops driving of the conveyance roller pair, and sets the separated the registration roller pair to the press-contact state after a succeeding sheet has stopped at a stop position near a nip portion of the registration roller pair. In addition, the control unit resumes the rotation of the conveyance roller pair after the registration roller pair has been set to the press-contact state, and rotates the registration roller pair backward and the conveyance roller pair forward to form a loop in the succeeding sheet between a nip portion of the conveyance roller pair and the nip portion of the registration roller pair.

According to an exemplary embodiment, a control unit sets a separated registration roller pair to a press-contact state after a sheet has been stopped at a stop position. The control unit rotates the registration roller pair backward during the loop formation in the sheet so that the leading edge of the sheet can reliably contact the nip portion of the registration roller pair. Thus, even when an interval between a preceding sheet and a succeeding sheet becomes shorter, skewing of the sheet can be surely corrected, and productivity and skew correction performance can be improved.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 7:
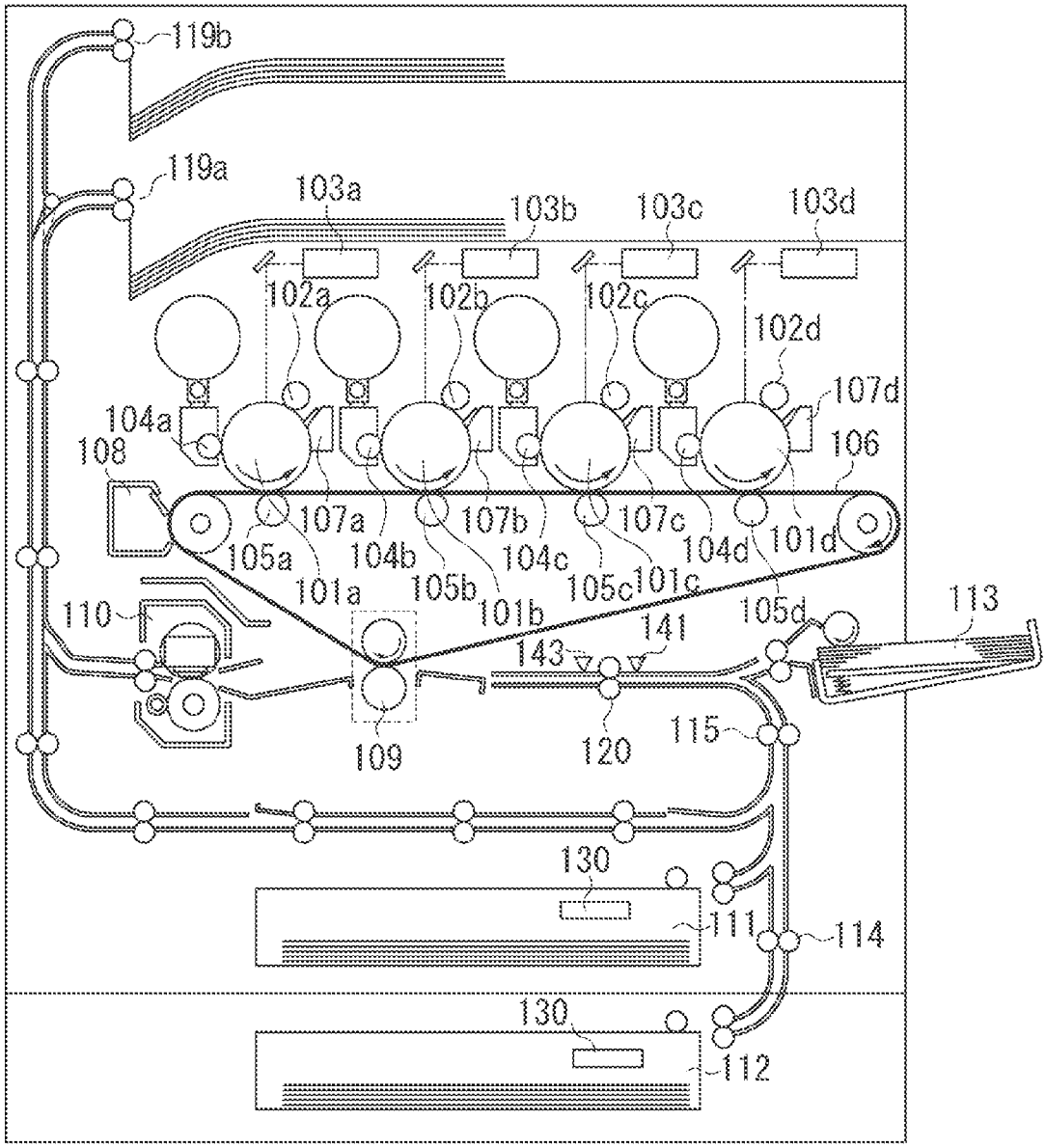
FIG. 7 is a diagram illustrating an overall configuration of the image forming apparatus according to the exemplary embodiment.

FIG. 7 is a schematic sectional view illustrating a color digital printer as an example of an image forming apparatus to which a sheet conveyance apparatus according to an exemplary embodiment.

First, an image forming unit will be described. Surfaces of four photosensitive drums 101*a* to 101*d* are uniformly charged by charging rollers 102*a* to 102*d*. Laser scanners 103*a* to 103*d*, to which image signals of yellow (Y), magenta (M), cyan (C), and black (K) are respectively input, irradiate the drum surfaces with laser beams according to the image signals, and neutralize charges to form latent images.

The latent images formed on the photosensitive drums are developed by toner of yellow, magenta, cyan, and black by developing devices 104*a* to 104*d*. The toner developed on the photosensitive drums is sequentially transferred to an intermediate transfer belt 106 that is an endless belt image bearing member by primary transfer rollers 105*a* to 105*d*, and a full-color toner image is formed on the intermediate transfer belt 106.

A sheet fed from one of sheet feeding cassettes 111 and 112 housing sheets is conveyed toward a registration roller pair 120 by a sheet feeding roller. A sheet fed from a manual sheet feeding unit 113 is conveyed to the registration roller pair 120. The toner image on the intermediate transfer belt 106 is controlled so that image misregistration from the sheet conveyed by the registration roller pair 120 can be prevented. The toner image is transferred to the sheet by a secondary transfer unit 109. Then, the toner image is heated and pressed to be fixed on the sheet by a fixing device 110. The sheet is subsequently discharged out of an apparatus body from a discharge unit 119*a* or 119*b*. In the image forming apparatus according to the present exemplary embodiment, the sheet is conveyed based on a center reference. Specifically, the sheet is conveyed by matching the center of a direction, which is orthogonal to a sheet conveying direction of a sheet conveyance path for conveying the sheet, with the center of a sheet width direction.

A user can input, from an operation unit (illustrated in FIG. 2) disposed in the image forming apparatus, various pieces of sheet information (size information, grammage information, and surface texture information) to a control unit described below. Further, the user can input, from a computer 201 connected to the image forming apparatus via a network, various pieces of sheet information to the control unit described below.

Each of the sheet feeding cassettes 111 and 112 has a size detection mechanism 130 for detecting a size of the housed sheet and causing the control unit of the image forming apparatus to recognize the size. The size detection mechanism 130 includes a rotatable size detection lever that slides and contact a side regulation plate for regulating a position of the sheet in a width direction. The side detection lever can rotate in conjunction with the side regulating plate. The side regulation plate, which is movable along a side edge of the sheet, can match a position of the sheet in the width direction with the image forming unit.

The size detection mechanism 130 includes, in a loading unit of the apparatus body into which the sheet feeding cassette is loaded, a plurality of sensors or switches arranged in a position corresponding to the size detection lever. Accordingly, when the side regulation plate is moved along the side edge of the sheet, the size detection lever is rotated in conjunction with the movement. When the sheet feeding cassette is loaded into the image forming apparatus, the size detection lever selectively turns ON/OFF the sensors or the switches included in the loading unit of the apparatus body. Thus, signals of different patterns are transmitted from the sensors or the switches. The image forming apparatus can then recognize sizes of the sheets housed in the sheet feeding cassettes based on the signals. A similar mechanism can be included as a size detection mechanism in the manual sheet feeding unit 113.

The side regulation plate has a function of preventing skewing of the sheet. In reality, however, when even a small gap is generated between the side regulation plate and the sheet, sheet skewing may occur. Skewing may also occur in the sheet fed from the sheet feeding unit during sheet conveyance.

The image forming apparatus according to the present embodiment includes the sheet conveyance apparatus that corrects skewing of the sheet by causing the leading edge of the conveyed sheet to contact the nip portion of the stopped registration roller pair 120 and setting the leading edge of the sheet along the nip portion while forming a loop on the sheet. A loop amount formed in the sheet needs to be set so that the leading edge of the sheet can surely contact the nip portion of the registration roller pair 120 and set along the nip portion. After the sheet has passed through a registration sensor 141, a conveyance roller pair 115 disposed upstream of the registration roller pair 120 feeds the sheet by a predetermined amount. Thus, an appropriate amount of loop is formed in the sheet.

Between the registration roller pair 120 and the secondary transfer roller 109, a contact image sensor (CIS) 143 is disposed as a width-direction detection unit to detect a position of the sheet in the width direction (direction orthogonal to the sheet conveying direction). The CIS 143 detects the position of the sheet conveyed by the registration roller pair 120 in the width direction, and the control unit described below calculates the amount of deviation between a detection result by the CIS 143 and a designated position. Then, by shifting the registration roller pair 120 in the width direction based on the calculated amount of deviation, the position of the sheet in the width direction is corrected to match the position of an image transferred by the image forming unit.

Figure 1:
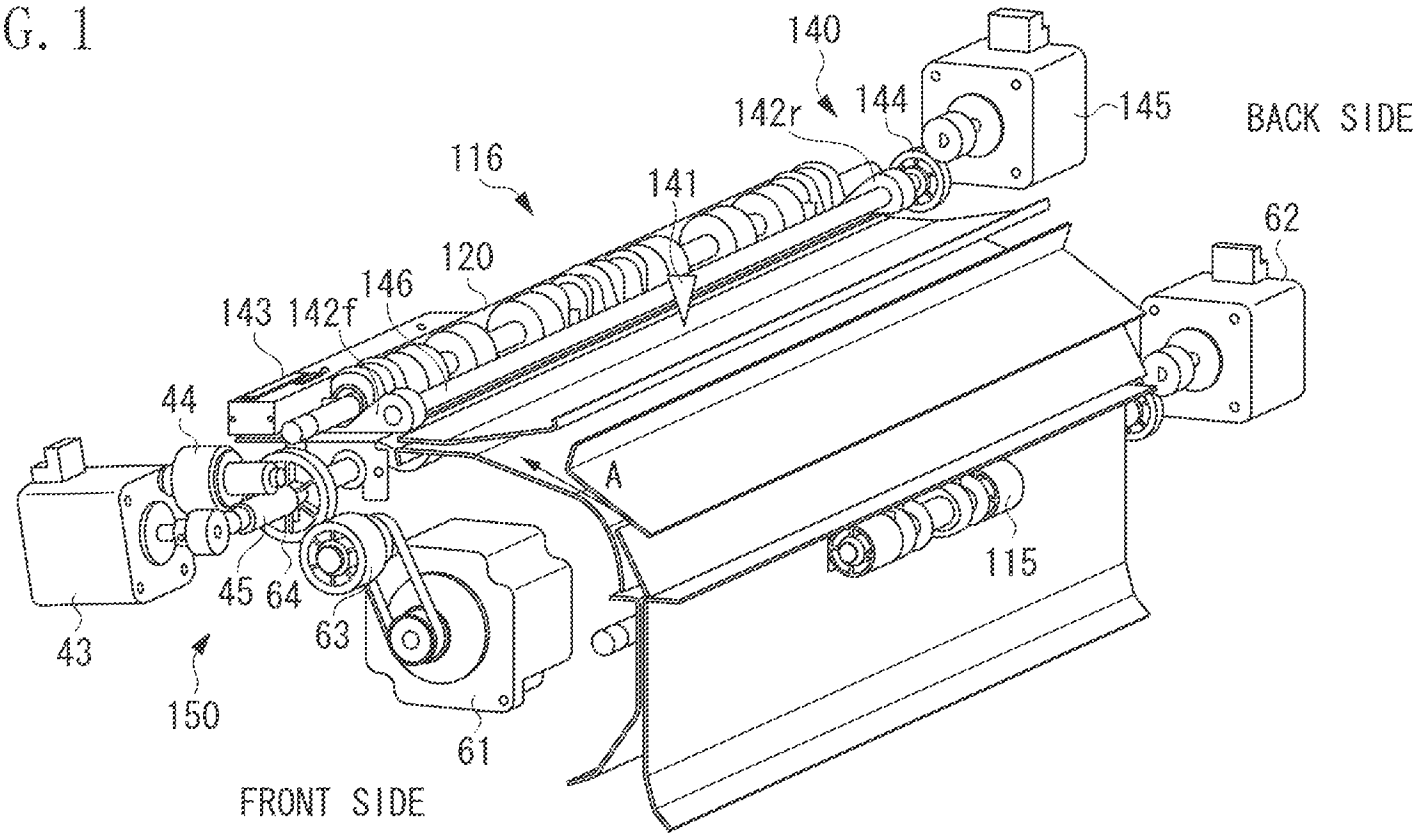
FIG. 1 is a diagram illustrating a sheet conveyance apparatus according to an exemplary embodiment.
Figure 2:
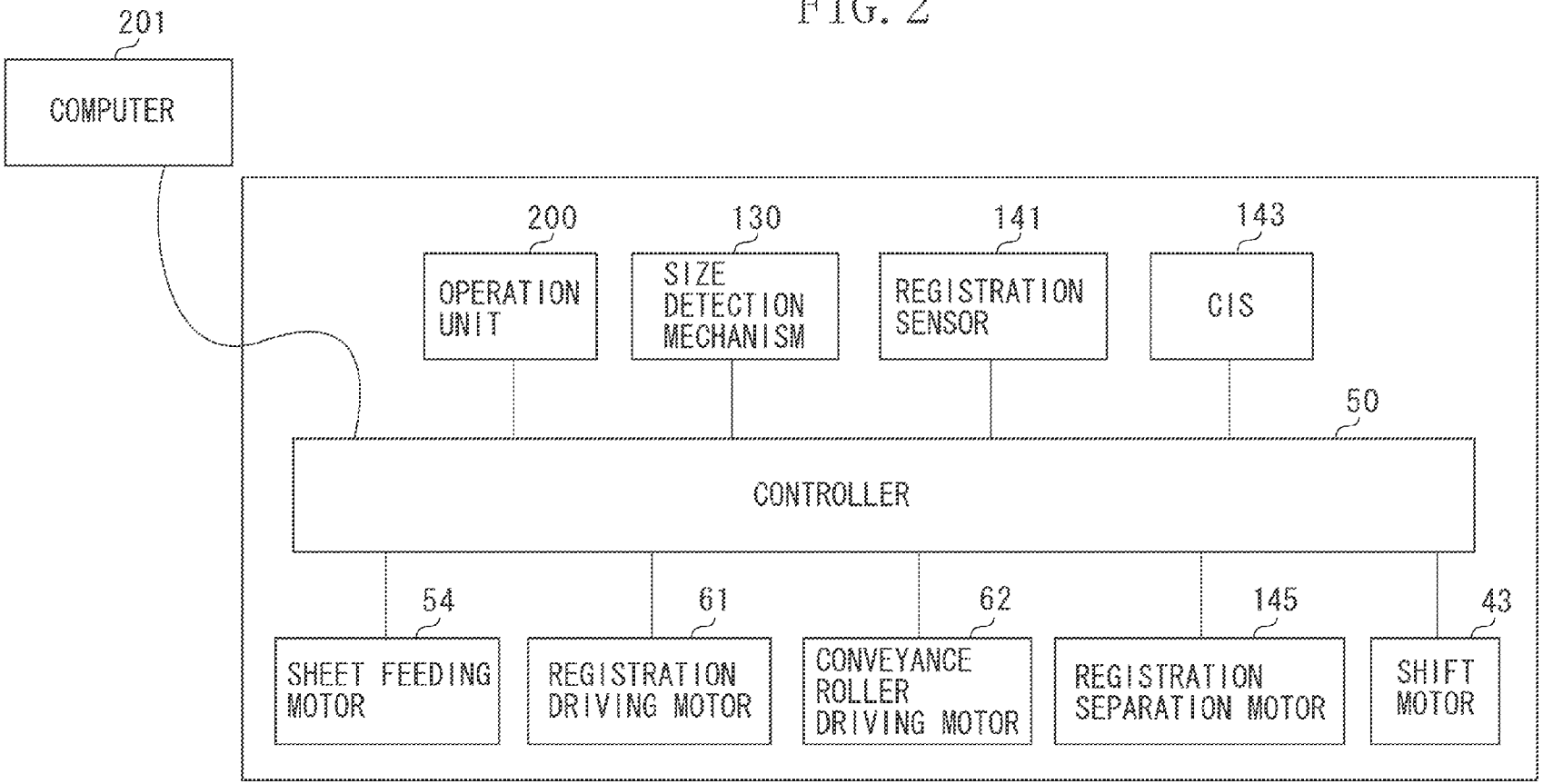
FIG. 2 is a block diagram illustrating an image forming apparatus according to the exemplary embodiment.
Figure 3:
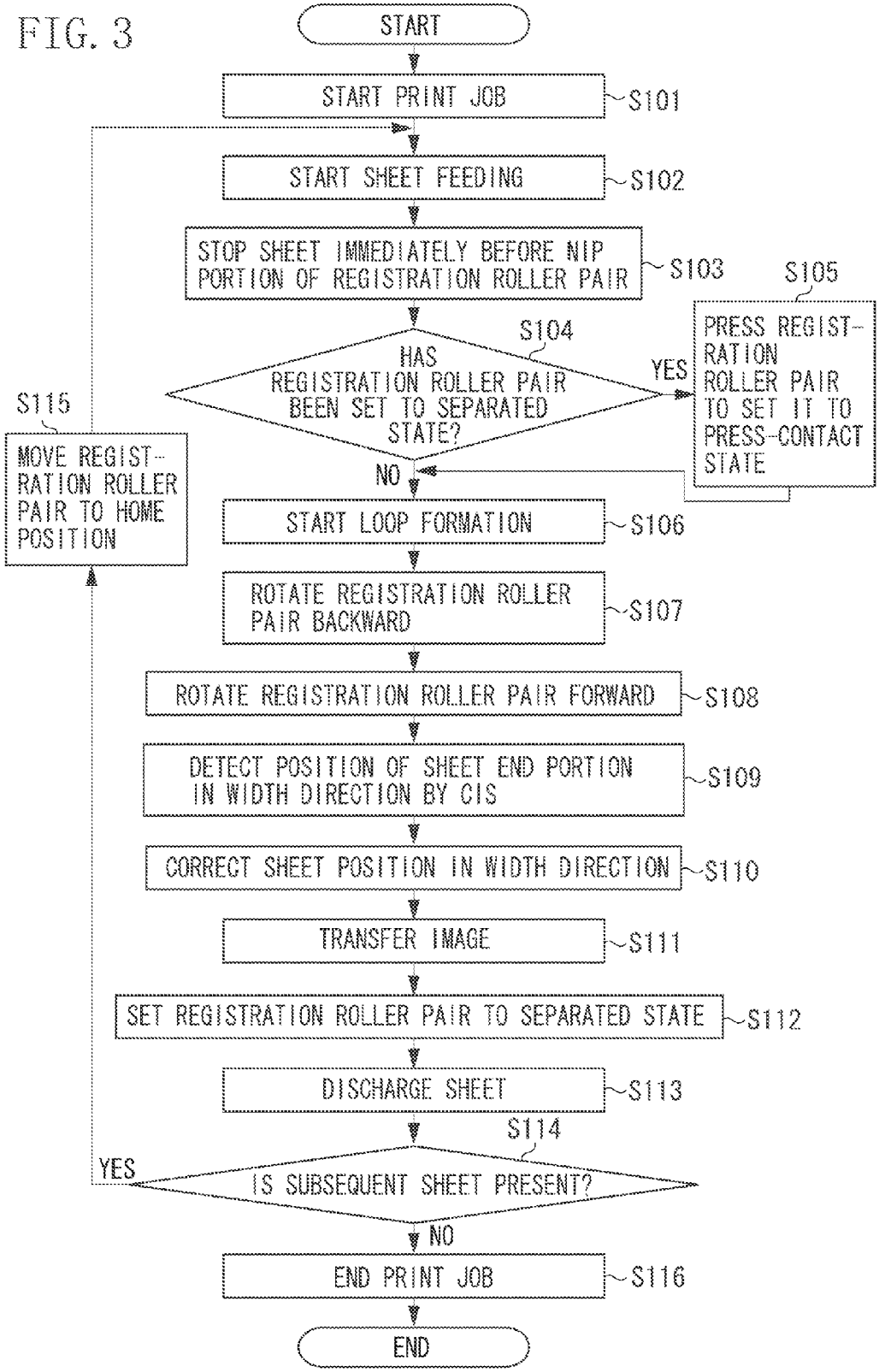
FIG. 3 is a flowchart illustrating a sheet skew correction operation and a lateral registration correction operation of the sheet conveyance apparatus according to the exemplary embodiment.

Next, the sheet conveyance apparatus according to the exemplary embodiment will be described. FIG. 1 is a perspective view showing the sheet conveyance apparatus 116 according to the exemplary embodiment, which is disposed in the midway of a sheet conveyance path for connecting the sheet feeding cassettes 111 and 112 and the image forming unit and configured to correct skewing of the sheet and the position of the sheet in the width direction. FIGS. 2 and 3 are schematic diagrams illustrating the sheet skew correction operation and the width-direction correction operation carried out by the sheet conveyance apparatus 116.

Figure 5:
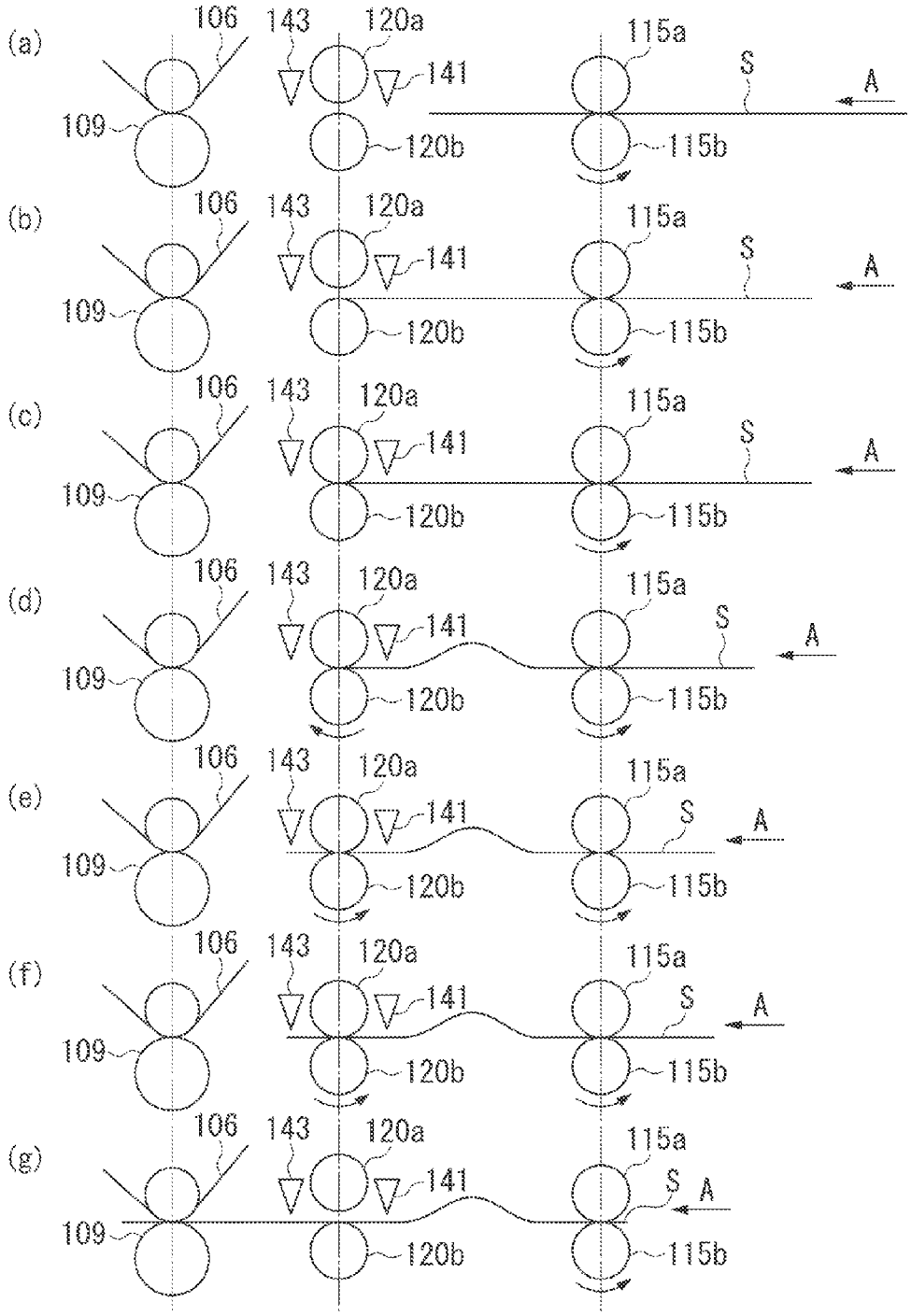
FIGS. 5(*a*), 5(*b*), 5(*c*), 5(*d*), 5(*e*), 5(*f*), and 5(*g*) are side views illustrating the sheet skew correction operation and the lateral registration correction operation according to the exemplary embodiment.

The conveyance roller pair 115 disposed in the sheet conveyance path includes, as illustrated in FIGS. 5(*a*) to 5(*g*), an upper conveyance roller 115*a* including a polyacetal (POM) roller and a lower conveyance roller 115*b* including a rubber roller arranged to face each other. The upper conveyance roller 115*a* is swingably supported by a lever, and press-contacted with the lower conveyance roller 115*b* by an elastic force of a spring (not illustrated).

The registration roller pair 120, which is disposed downstream of the conveyance roller pair 115 and configured as a contact portion contacted by the leading edge of the sheet to correct skewing of the sheet, includes an upper roller 120*a* and a lower roller 120*b*. The skewing of the sheet is corrected by contacting the leading edge of the sheet along the nip portion formed by the upper roller 120*a* and the lower roller 120*b*. The upper roller 120*a* of the registration roller pair 120 includes a polyacetal (POM) roller and the lower roller 120*b* includes a rubber roller, and the upper roller 120*a* and the lower roller 120*b* are arranged to face each other. The upper roller 120*a* is swingably supported by a lever, and press-contacted with the lower roller 120*b* by an elastic force of a spring (not illustrated).

Referring to FIG. 1, the sheet conveyance apparatus 116 includes a conveyance roller driving motor 62 configured, as a conveyance roller driving unit, to drive the lower conveyance roller 115*b* of the conveyance roller pair 115, and a registration motor 61 configured, as a registration driving unit, to drive the lower roller 120*b* of the registration roller pair 120.

Next, a width-direction correction unit 150 configured to correct the position of the sheet in the width direction by moving the registration roller pair 120 in the width direction of the sheet will be described.

The lower roller 120*b* of the registration roller pair 120 is fixed to a registration roller rotary shaft 120S. The registration roller rotary shaft 120S is fixed to the apparatus body to be movable in the width direction of the sheet. The movement of the registration roller rotary shaft 120S in the width direction of the sheet is accompanied by integral movement of the upper roller 120*a* and the lower roller 120*b* in the width direction of the sheet.

The width-direction correction unit 150 includes a pinion gear 44 and a rack 45. The rack 45 is supported by the registration roller rotary shaft 120S to be rotatable in a rotational direction while being fixed in the width direction of the sheet.

With this configuration, a shift motor 43 as a width-direction correction unit driving unit is driven to rotate the pinion gear 44 and move the rack 45 in the width direction of the sheet. This enables the registration roller pair 120 to move in the width direction of the sheet, and thus the sheet nipped by the registration roller pair 120 can be moved in the width direction of the sheet. A registration roller idler gear 63 includes a tooth of larger width than that of a registration roller input gear 64. This is for the purpose of maintaining gear engagement to enable rotation of the registration roller pair 120 even when the registration roller pair 120 and the registration roller input gear 64 move in the width direction.

The CIS 143 is disposed as a detection unit configured to detect the side edge of the sheet downstream of the registration roller pair 120. The CIS 143 is located upstream of the image forming unit, deviating from the center in the width direction of the sheet. This is because it is enough to detect one side edge of the sheet. A width-direction length of the CIS 143 is set so that the smallest-width sheet and the largest-width sheet can be detected.

Next, a separation press-contact mechanism 140 for setting the registration roller pair 120 to the separated state and the press-contact (contact) state will be described. The separation press-contact mechanism 140 can set a sheet nipping force to 0 at the nip portion of the registration roller pair 120 by separating the upper roller 120*a* from the lower roller 120*b*. The separation press-contact mechanism 140 causes the separated upper roller 120*a* to press and contact the lower roller 120*b* to set the registration roller pair 120 to a nipping state.

The separation press-contact mechanism 140 includes a registration separation motor 145, an input gear 144, a separation shaft 146, and separation levers 142*f* and 142*r*. An output gear of the second lower roller separation motor 145 is engaged with the input gear 144. The input gear 144 is fixed to an end of the shaft 143. The separation levers 142*f* and 142*r* fixed to the separation shaft 146 are in contact with a shaft of the first lower roller 115*b* from above.

With this configuration, when the registration separation motor 145 rotates in a counterclockwise direction in FIG. 1 by a predetermined amount as viewed from the front side of the apparatus, the separation shaft 146 is driven to rotate, and the separation levers 142*f* and 142*r* are rotated in a clockwise direction. Accordingly, the upper roller 120*a* is lifted by an elastic force of a spring (not illustrated) to be separated from the lower roller 120*b*. When the registration separation motor 145 is rotated reversely (in the clockwise direction), the separation levers 142*f* and 142*r* are rotated in the counterclockwise direction via the separation shaft 146. As a result, the upper roller 120*a* is press-contacted with the lower roller 120*b*.

Next, referring to the schematic diagrams in FIGS. 4A to 4G and FIGS. 5(*a*) to 5(*g*), the sheet skew correction operation and the with-direction position correction operation of the sheet conveyance apparatus 116 will be described. FIGS. 4A to 4G are upper views, and FIGS. 5(*a*) to 5(*g*) are side views. FIGS. 4A to 4G respectively correspond to FIGS. 5(*a*) to 5(*g*).

Figure 4A:
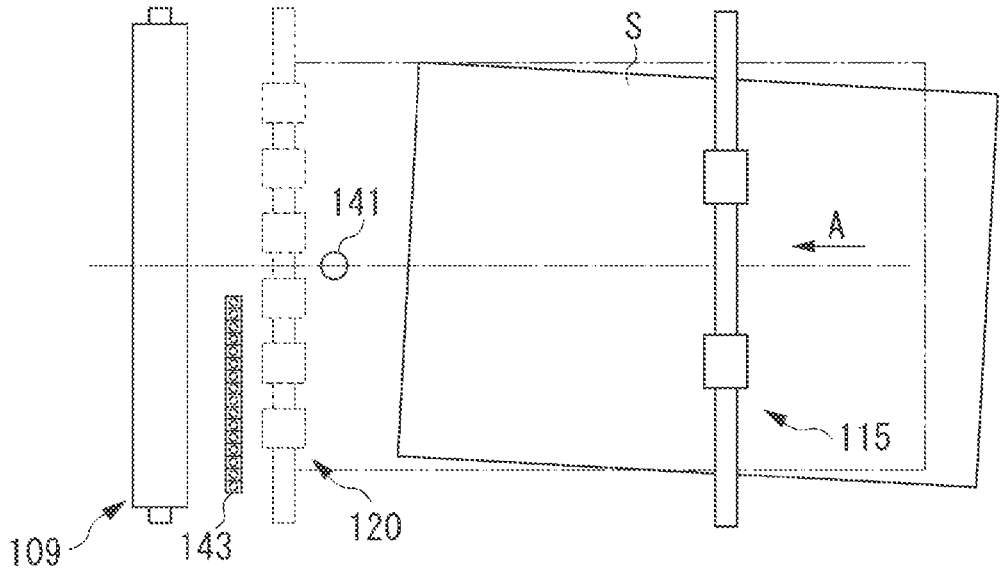
FIGS. 4A, 4B, 4C, 4D, 4E, 4F, and 4G are upper views illustrating the sheet skew correction operation and the lateral registration correction operation according to the exemplary embodiment.

A skew correction operation performed when the sheet is skewed left with respect to a conveying direction A as illustrated in FIG. 4A will be described. When the conveyance roller pair 115 rotates from a state illustrated in FIG. 4A to convey the sheet in the conveying direction A, the leading edge of the sheet at the center downstream of the conveying direction is detected by the registration sensor 141.

Figure 4B:
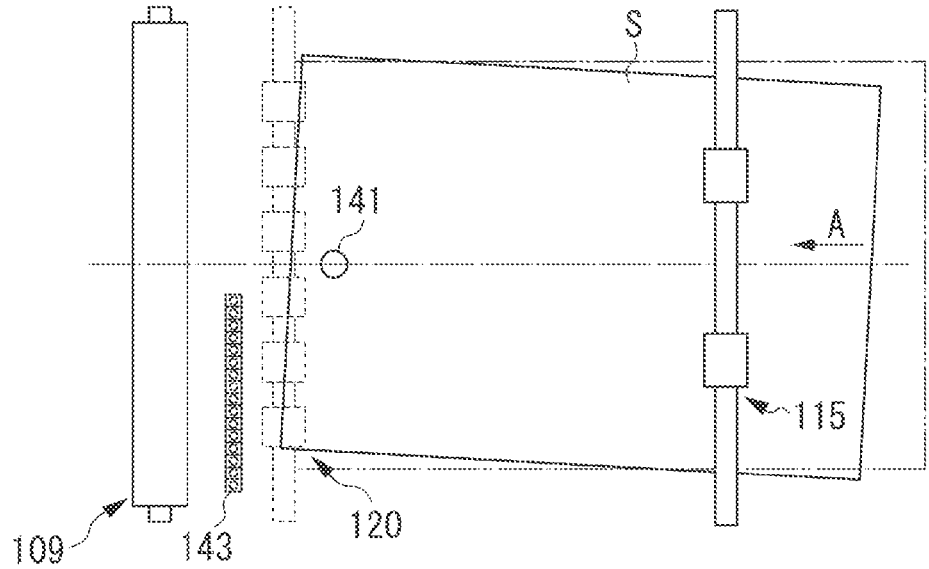

After the registration sensor 141 has detected the sheet, a controller 50 stops driving of the conveyance roller driving motor 62 based on the detection result, thereby stopping the rotation of the conveyance roller pair 115. Then, as illustrated in FIGS. 4B and 5(*b*), the sheet stops at a stop position immediately before the nip portion of the registration roller pair 120 (0.5 mm distance before the nip portion). As shown in FIGS. 4A to 4G, the registration sensor 141 is disposed roughly in the center of the width direction in the sheet conveyance path. The sheet stop position is determined based on the center reference of the width-direction of the sheet conveyance path. In the present exemplary embodiment, when the conveyed sheet is not skewed, the stop position of sheet is set so that the leading edge of the sheet can stop upstream of the nip portion of the registration roller pair 120. Thus, as illustrated in FIG. 4B, when the sheet is greatly skewed, a corner portion of a leading edge side of a preceding skewed sheet may reach a position exceeding the nip portion of the registration roller pair 120.

The leading edge of the sheet does not always need to be set upstream of the nip portion of the registration roller pair 120. It only needs to be set near the nip portion of the registration roller pair 120.

At this time, the registration roller pair 120 is set in the separated state by the separation press-contact mechanism 140 to convey the sheet only by the secondary transfer roller 109, after the preceding sheet has been conveyed to the secondary transfer roller 109.

Figure 4C:
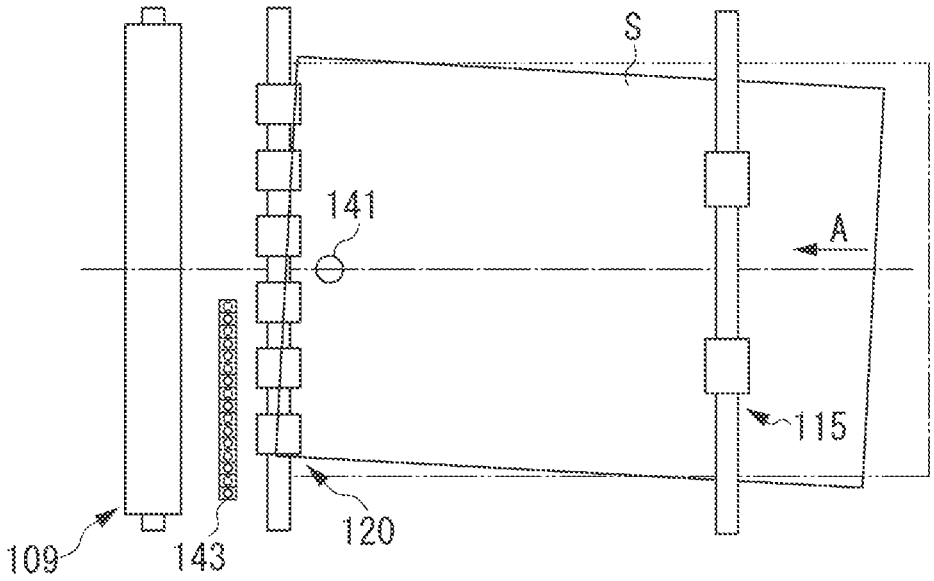

Then, when the separated registration roller pair 120 is set to a press-contact state, as illustrated in FIGS. 4C and 5(*c*), the corner portion of the leading edge side of the sheet is nipped by the registration roller pair 120. Even when a loop is formed in the sheet by rotating the conveyance roller pair 115 forward in the nipped state of the corner portion of the sheet, the sheet leading edge cannot be aligned with the nip portion of the registration roller pair 120. Thus, the skewing of the sheet cannot be corrected.

Figure 4D:
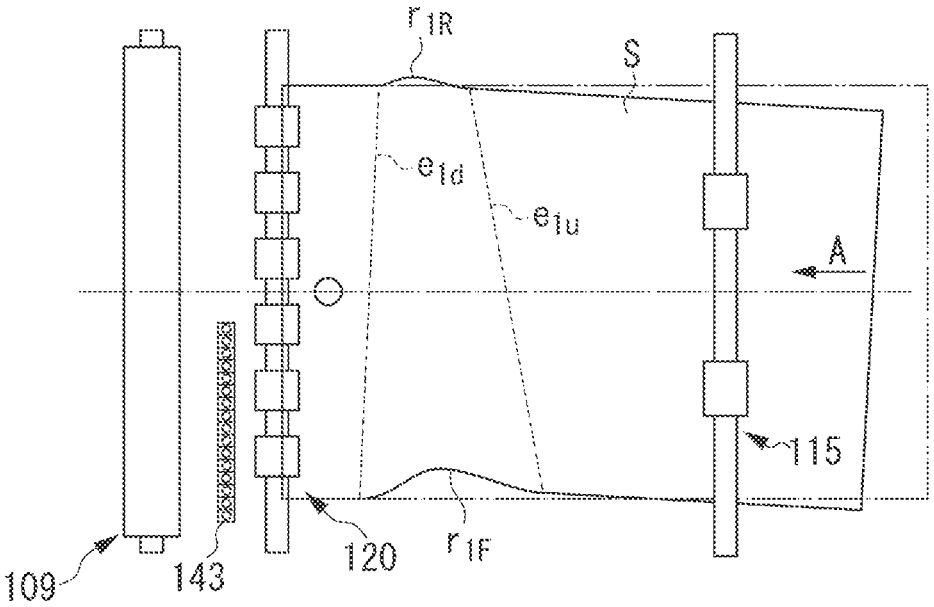

Therefore, in the present exemplary embodiment, to convey (return) the corner portion of the leading edge side of the nipped sheet to the upstream side of the nip portion of the registration roller pair 120, the registration roller pair 120 is reversely rotated. Specifically, as illustrated in FIGS. 4D and 5(*d*), the leading edge of the nipped sheet is returned by reversely rotating the registration roller pair 120 while rotating the conveyance roller pair 115 forward to form a loop in the sheet. Thus, the sheet leading edge can be aligned with the nip portion of the registration roller pair 120 to correct the skewing of the sheet.

The amount of loop formed in the sheet for correcting the skewing of the sheet is appropriately set based on a size or grammage (hereinafter, referred to as sheet information) of the sheet. The controller 50 determines an optimal amount of loop based on sheet information designated from the operation unit 200 by the user, sheet information detected by the size detection mechanism 130, or a combination thereof.

Figure 4E:
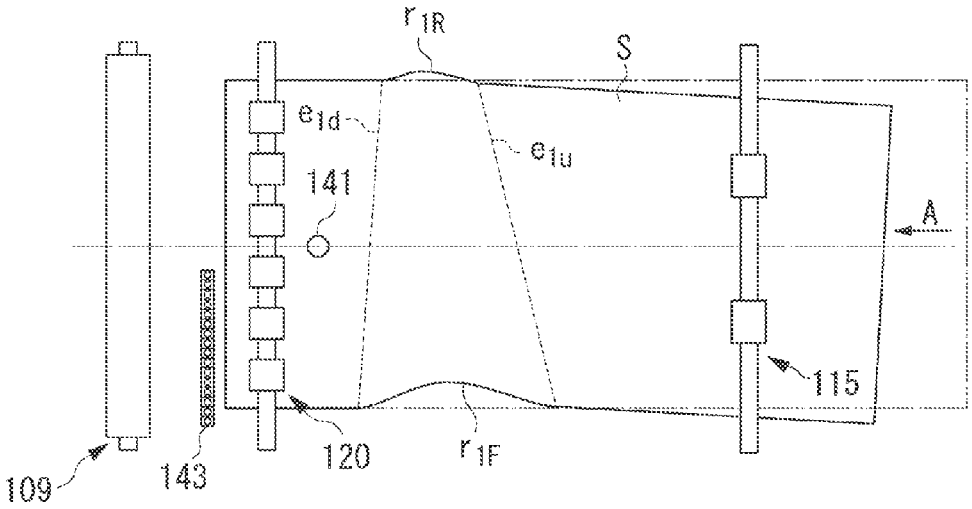

Then, as illustrated in FIGS. 4E and 5(*e*), the registration roller pair 120 and the conveyance roller pair 115 are rotated to convey the sheet S in the skew-corrected state.

Then, the side edge of the sheet conveyed by the registration roller pair 120 is detected by the CIS 143. The controller 50 controls movement of the registration roller pair 120 in the width direction by the width-direction correction unit 150 based on the detection result by the CIS 143.

Figure 4F:
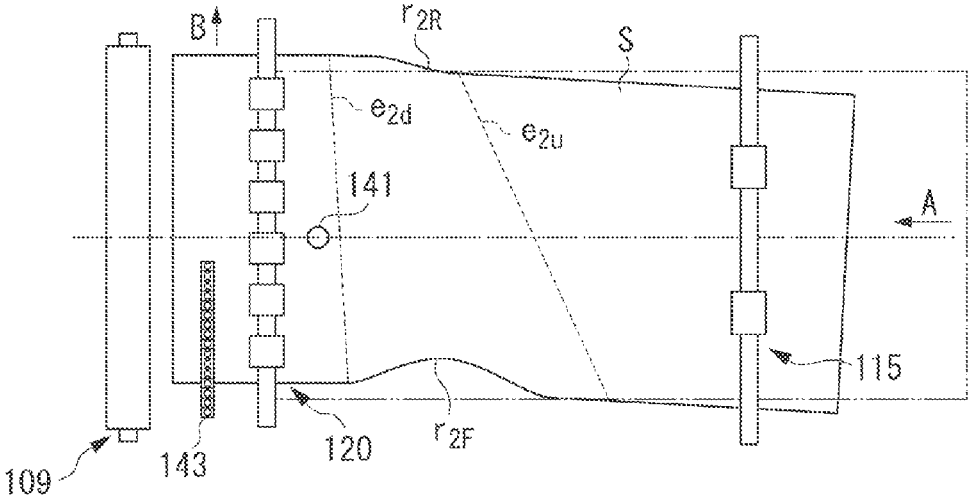

As illustrated in FIGS. 4F and 5(*f*), the width-direction correction unit 150 moves the registration roller pair 120 in a direction B illustrated in FIG. 4F to correct the position of the sheet in the width direction.

Figure 4G:
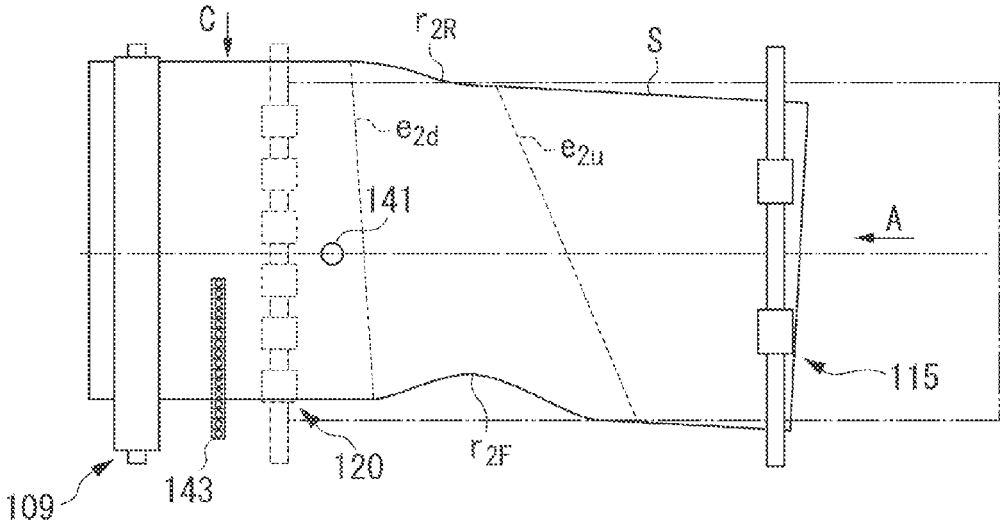

Then, as illustrated in FIGS. 4G and 5(*g*), after the leading edge of the sheet conveyed by the registration roller pair 120 has reached the secondary transfer unit 109, the registration roller pair 120 is set to the separated state by the separation press-contact mechanism 140. While the registration roller pair 120 is in the separated state, the registration roller pair 120 is moved in a direction C illustrated in FIG. 4G by driving of the shift motor 43, and returned to the center position (home position).

When there is a succeeding sheet, the operations, starting from the operation illustrated in FIGS. 4A and 5(*a*), is repeated.

As described above, in the present exemplary embodiment, the press-contact operation of the registration roller pair 120 is carried out while the sheet is in the stopped state at the stop position. While the registration roller pair 120 is in the separated state, the shift motor 43 moves the registration roller pair 120 to the home position. These operations are carried out because, as described above, as a result of increasing sheet output productivity, it is difficult to secure time for the operations performed when an interval between the preceding sheet and the succeeding sheet is set to be narrower.

The control unit of the sheet conveyance apparatus 116 according to the present exemplary embodiment and flows of the sheet skew correction operation and the width-direction position correction operation by the control unit will be described referring to the drawings.

First, as illustrated in the block diagram in FIG. 2, the controller 50 as the control unit is connected to the operation unit 200 and the size detection mechanism 130 of the image forming unit. The controller 50 is also connected to the registration sensor 141, the registration motor 61 as the registration driving unit, the sheet feeding motor 54, and the conveyance roller driving motor 62 as the conveyance roller driving unit. The controller 50 is further connected to the registration separation motor 145, the shift motor 43, and the CIS 143.

Referring to FIG. 3, a control flow of the controller 50 will be described. First, in step S101, the user executes a print job from the operation unit 200 of the image forming apparatus or the computer 201 connected to the image forming apparatus directly or via a network. In this case, the user can designate the number of prints and sheet information about sheets to be used. The sheet information can also be detected by the size detection mechanism 130.

For the execution of the print job, in step S102, a sheet feeding operation is started, and a sheet is conveyed to the conveyance roller pair 115. The sheet nipped and conveyed by the conveyance roller pair 115 is detected by the registration sensor 141. In step S103, based on the detection result by the registration sensor 141, the controller 50 controls the conveyance roller driving motor 62 to stop the conveyed sheet at the stop position immediately before the nip portion of the registration roller pair 120. The sheet is stopped at the stop position for the purpose of conveying the stopped sheet at a low speed to be press-contacted with the nip portion of the registration roller pair 120.

The controller 50 pre-stores a table indicating correspondence between sheet information and an amount of loop formed in a sheet. The controller 50 determines, according to the sheet information of the conveyed sheet, and referring to the table, the amount of loop (sheet conveyance amount by the conveyance roller pair 115 to form an appropriate loop in the sheet) formed in the sheet for sheet skew correction.

In step S104, the controller 50 determines whether the registration roller pair 120 is in the separated state. In the case of a first sheet for the print job, the registration roller pair 120 is not in the separated state but in the press-contact state. On the other hand, in the case of a second sheet and subsequent sheets for the print job, the registration roller pair 120 is in the separated state during conveyance of a preceding sheet. Thus, in step S105, the controller 50 controls driving of the registration separation motor 145 to set the registration roller pair 120 to the press-contact state.

Then, in step S106, after a predetermined time has elapsed, the controller 50 controls driving of the conveyance roller driving motor 62 to resume the rotation of the conveyance roller pair 115, and forms a loop in the sheet to carry out a skew correction operation. At this time, the controller 50 rotates the registration driving motor 61 by a predetermined amount in a direction opposite to the direction of normal conveyance. Accordingly, in step S107, the registration roller pair 120 is reversely rotated to form a loop in the sheet with the resumed rotation of the conveyance roller pair 115. The controller 50 simultaneously carries out the reverse rotation of the registration roller pair 120 and the rotation of the conveyance roller pair 115 after the separated registration roller pair 120 has been set to the press-contact state. However, the controller 50 can start the reverse rotation of the registration roller pair 120 before the operation of setting the registration roller pair 120 to the press-contact state is completed.

After a predetermined amount of loop is formed in the sheet, in step S108, the controller 50 rotates the registration roller pair 120 forward, and the sheet is conveyed to the downstream side while the skew-corrected state is maintained.

After the sheet has been conveyed to the downstream side by the registration roller pair 120, in step S109, the position of an end portion of the sheet in the width direction is detected by the CIS 143.

Then, the controller 50 controls, based on the detection result by the CIS 143, the width-direction correction unit 150 to move the registration roller pair 120 in the width direction. Accordingly, in step S110, the position of the sheet in the width direction is corrected to match an image transferred by the image forming unit. At this time, the controller 50 calculates the amount of deviation in the width direction between the position of the sheet end portion and a normal position. The controller 50 controls the registration roller pair 120 by the calculated amount of deviation in the width direction, thereby correcting the position of the sheet in the width direction. The normal position means a position of the sheet end portion when the sheet is conveyed without being shifted in position in the width direction, which is determined for each sheet size. The controller 50 pre-stores a table indicating correspondence between each sheet size and the normal position of the end portion of the sheet in the width direction. The controller 50 refers to the table and determines, according to the position of the end portion of the sheet in the width direction detected by the CIS 143, a moving amount of the registration roller pair 120 in the sheet width direction.

In step S111, the sheet corrected in position in the width direction is conveyed to the secondary transfer unit, and the secondary transfer unit transfers an image to the sheet. In step S112, the controller 50 controls driving of the registration separation motor 145 of the separation press-contact mechanism 140 to set the registration roller pair 120 during the conveyance of the sheet by the secondary transfer roller. In step S113, the sheet to which the image has been transferred is discharged through a fixing step.

Then, in step S114, the controller 50 determines whether there is any succeeding sheet. When a succeeding sheet is present (YES in step S114), then in step S115, the controller 50 moves the registration roller pair 120 to the home position by the shift motor 43 while the registration roller pair 120 is in the separated state. When no succeeding sheet is present (NO in step S114), then in step S116, the controller 50 ends the print job.

Figure 6:
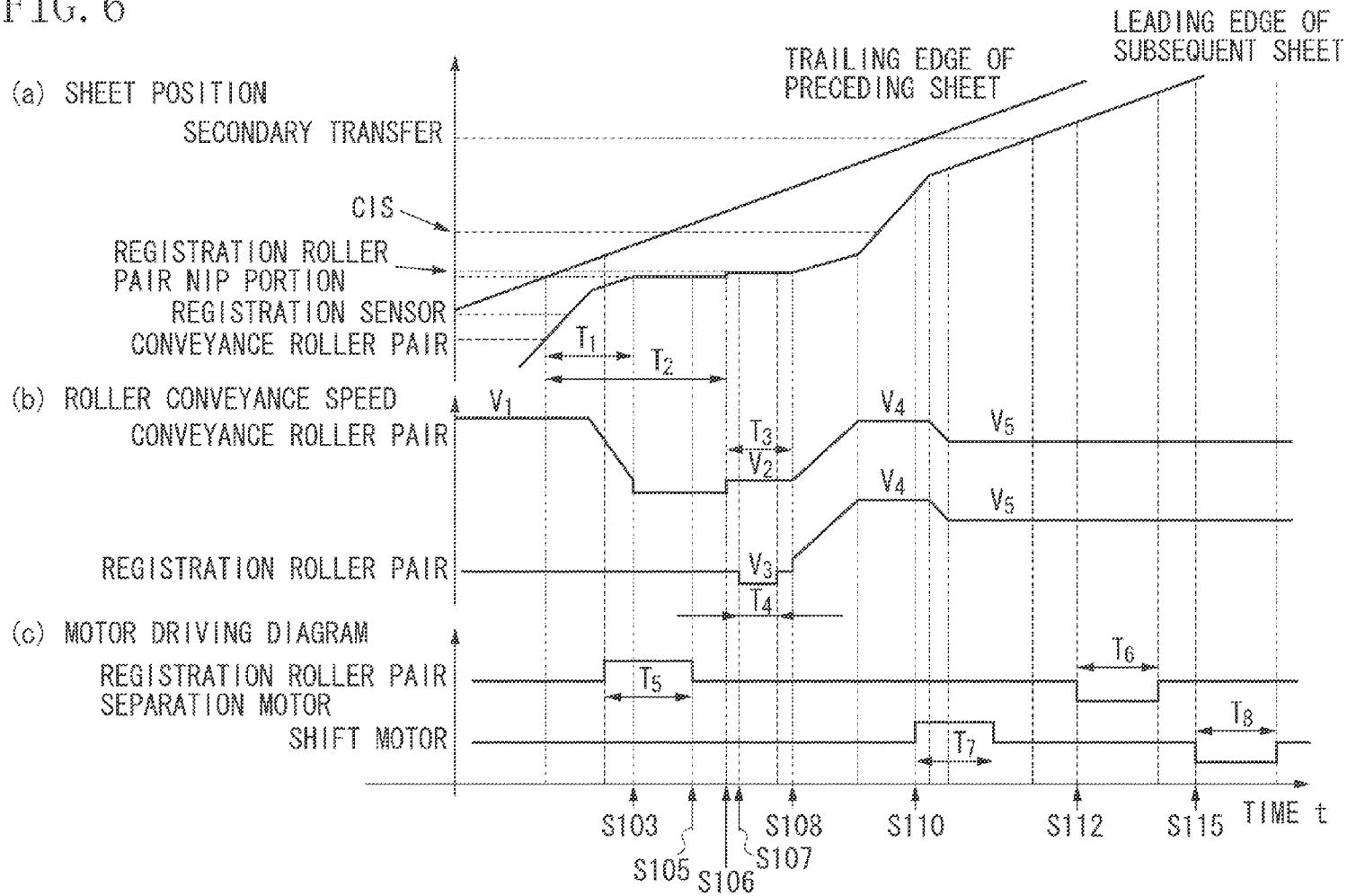
FIG. 6 is a diagram illustrating a conveyance diagram and a motor driving diagram according to the exemplary embodiment.

FIG. 6 illustrates a diagram indicating the position of the sheet in the sheet conveying direction and a motor driving diagram corresponding to the flow. The diagram (a) illustrated in FIG. 6 indicates the position of the sheet conveyed by the sheet conveyance apparatus 116. A horizontal axis indicates time, and a vertical axis indicates positions of the trailing edge of a preceding sheet and the leading edge of a succeeding sheet. A diagram (b) illustrated in FIG. 6 indicates motor driving of the conveyance roller and the registration roller. A diagram (c) illustrated in FIG. 6 indicates driving of the registration separation motor and the shift motor. Step numbers in the graph correspond to the flowchart in FIG. 3.

In the example illustrated in FIG. 6, an image forming speed $V_5$=360 mm/s and productivity 90 pages per minute (PPM) are set. A conveying speed $v_1$ at which the conveyance roller pair 115 conveys the sheet to the stop position immediately before the registration roller pair 120 is 800 mm/s. On the other hand, a conveying speed $v_2$ at which the conveyance roller pair 115 conveys the sheet from the stop position to the nip portion of the registration roller pair 120 is 100 mm/s. A speed $v_3$ at which the sheet is conveyed to the upstream side in the conveying direction by reversely rotating the registration roller pair 120 is 100 mm/s. A conveying speed $v_4$ of the conveyance roller pair 115 and the registration roller pair 120 after the loop has been formed in the sheet to correct the sheet skewing is 800 mm/s. In other words, the sheet conveying speed of the conveyance roller pair 115 and the registration roller pair 120 after the loop has been formed is faster than that of the conveyance roller pair 115 and the registration roller pair 120 during the loop formation.

In the present exemplary embodiment, time $T_1$ from when the trailing edge of the preceding sheet exits the nip portion of the registration roller pair 120 until the leading edge of the succeeding sheet arrives at the stop position is 52 ms. If the sheet is contacted with the registration roller pair 120 while reducing the speed of the conveyance roller pair 115 without stopping the sheet at the stop position, time between sheets almost corresponds to $T_1$. The time between the sheets means time from when the trailing edge of the preceding sheet exits the registration roller pair 120 until the leading edge of the succeeding sheet arrives at the registration roller pair 120.

Time $T_5$ necessary for the operation of setting the separated registration roller pair 120 to the press-contact state by the registration separation motor 145 of the separation press-contact mechanism 140 is 70 ms, which is longer than the time between the sheets, which is 52 ms. In other words, the press-contact operation of the registration roller pair 120 cannot be completed within the time from when the trailing edge of the preceding sheet exits the registration roller pair 120 until the leading edge of the succeeding sheet arrives at the registration roller pair 120.

To shorten the time necessary for the operation of setting the separated registration roller pair 120 to the press-contact state, motor torque needs to be increased. When the motor toque is increased, costs are increased, temperature of the motor is increased, and vibration is increased by the separation/press-contact operations. Although the time $T_1$ between the sheets may be lengthened by lowering the sheet conveying speed, this is not desirable because productivity (number of image formed sheets per unit time) is decreased.

In the present exemplary embodiment, the registration roller pair 120 is set to the press-contact state after the succeeding sheet stops at the stop position. Thus, time T2 between the sheets from when the trailing edge of the preceding sheet exits the nip portion of the registration roller pair 120 until the leading edge of the succeeding sheet arrives at the nip portion of the registration roller pair 120 is to be 107 ms.

The conveying speed $v_2$ at which the conveyance roller pair 115 conveys the sheet stopped at the stop position to the nip portion of the registration roller pair 120 is 100 mm/s. Similarly, the speed $v_3$ at which the registration roller pair 120 is reversely rotated is 100 mm/s. This can reduce hitting sound or damage of the sheet leading edge generated or caused when the sheet is contacted with the nip portion of the registration roller pair 120. In the present exemplary embodiment, time $T_3$ for forming the loop in the sheet is 50 ms, and thus a loop of $v_2 \times T_3 = 5$ mm can be formed.

When an input skew amount permitted in the sheet conveyance apparatus 116 according to the present exemplary embodiment is set to 5 mm, a maximum amount of the corner portion of the preceding sheet nipped when the separated registration roller pair 120 is set to the press-contact state is to be 2.5 mm. This is because since the registration sensor 141 is located at the center in the sheet width direction, the amount of the sheet nipped when the registration roller pair 120 is set to the press-contact state is half of a sheet skew amount. Thus, a minimum necessary reverse rotation amount of the registration roller pair 120 is to be 2.5 mm, which is half of the permitted input skew amount.

Thus, when time $T_4$ for reversely rotating the registration roller pair 120 at the reverse rotation speed $v_3$ (100 mm/s) is set to 30 ms, the sheet can be returned by up to 3 mm to the upstream side. Thus, the reverse rotation of the registration roller pair 120 needing the time $T_4$ can be carried out within the time T3 for forming the loop in the sheet.

Thus, the entire corner portion of the preceding side of the sheet nipped during the setting of the registration roller pair 120 to the press-contact state can be returned to the upstream side of the nip portion of the registration roller pair 120. As a result, sheet skew correction performance can be achieved without lowering sheet productivity.

From the standpoint of productivity, it is not desirable to set the sheet stop position to be more upstream so that the corner portion of the skewed sheet is not nipped when the separated registration roller pair 120 is set to the press-contact state. This is because the sheet conveying speed when the sheet is contacted with the nip portion of the registration roller pair 120 from the stop position need to be set low as described above, and setting a longer distance from the stop position to the nip portion of the registration roller pair 120 lowers productivity greatly.

This case will be described by using a specific example. When a permitted input skew amount is set to 5 mm as in the case of the present exemplary embodiment, if the stop position is set at 2.5 mm or more before the nip portion of the registration roller pair 120, the corner portion of the sheet is not nipped when the registration roller pair 120 is set to the press-contact state. However, since the distance from the stop position to the nip portion of the registration roller pair 120 is longer by 2.0 mm, extra time of 2.0 mm/100/s=20 ms is necessary for conveying the sheet. Therefore, to achieve the same productivity as that of the present exemplary embodiment, the sheet conveying speed to reach the stop position needs to be increased by 20 ms. Specifically, an interval between the trailing edge of the preceding sheet and the leading edge of the succeeding sheet need to be shortened. This increases a possibility that the sheet is damaged or sheet jamming occurs since the preceding sheet can be hit by the succeeding sheet. The speed $v_4$ after the restarting of the registration roller pair 120 may be set faster. However, the motor size needs to be increased, and this undesirably increases product size and cost.

Thus, in the present exemplary embodiment, to improve productivity and skew correction accuracy, the stop position of the sheet is set to a position as close as possible to the registration roller pair 120 and the registration roller pair 120 is reversely rotated.

Time $T_7$ for moving the registration roller pair 120 from the home position in the width direction and time $T_8$ for moving the registration roller pair 120 from the moved position to the home position are 70 ms. Thus, the operation of moving the registration roller pair 120 to the home position is carried out while the registration roller pair 120 is in the separated state of.

The diagram indicating the position in the sheet conveying direction and the motor driving diagram illustrated in FIG. 6 have been described by using the specific numerical values, but the exemplary embodiment is not limited to these values.

The present exemplary embodiment has been directed to the configuration where the width-direction position correction operation is carried out by the width-direction correction unit 150. However, in another exemplary embodiment, the width-direction correction unit 150 need not be included.

The present exemplary embodiment has been described with the configuration where the CIS is located downstream of the registration roller pair 120. However, in another exemplary embodiment, the CIS can be located upstream of the registration roller pair 120.

The present exemplary embodiment has been described with the configuration where the reverse rotation is started after the separated registration roller pair 120 has been set to the press-contact state. However, in other exemplary embodiments, another configuration can be used, such as the reverse rotation starting before the registration roller pair 120 is set to the press-contact state.

As described above, according to the present exemplary embodiment, in the configuration where the registration roller pair is set to the press-contact state after the sheet has stopped at the stop position, the registration roller pair is reversely rotated during the loop formation. This enables the stop position to be set immediately before the registration roller pair and the distance from the stop position to the registration roller pair to be set shorter, thus improving productivity. Furthermore, since the sheet nipped when the registration roller pair is set to the press-contact state can be returned to the upstream side by reversely rotating the registration roller pair, sheet skew correction performance can be improved.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-102481 filed Apr. 27, 2012, which is hereby incorporated by reference herein in its entirety.

What is claimed is:

1. A sheet conveyance apparatus comprising:

a conveyance roller pair configured to nip and convey a sheet;

a conveyance roller driving unit configured to drive the conveyance roller pair;

a registration roller pair disposed downstream of the conveyance roller pair and configured to nip and convey the sheet to a transfer unit;

a registration driving unit configured to drive the registration roller pair to rotate forward and backward, wherein the registration driving unit rotates the registration roller pair forward to convey the sheet downstream in a conveying direction, and rotates the registration roller pair backward to convey the sheet upstream in the conveying direction;

a separation and press-contact unit configured to set the registration roller pair to a separated state and to a press-contact state; and a control unit configured to control the conveyance roller driving unit, the registration driving unit, and the separation and press-contact unit, wherein the control unit sets the registration roller pair to the separated state after a leading edge of a preceding sheet conveyed downstream in the conveying direction by the registration roller pair has reached the transfer unit, wherein the control unit stops driving of the conveyance roller pair, and set the separated registration roller pair to the press-contact state after a succeeding sheet has stopped at a stop position near a nip portion of the registration roller pair; and wherein the control unit resumes the rotation of the conveyance roller pair after the registration roller pair has been set to the press-contact state, and rotates the registration roller pair backward and the conveyance roller pair forward to form a loop in the succeeding sheet between a nip portion of the conveyance roller pair and the nip portion of the registration roller pair.

2. The sheet conveyance apparatus according to claim 1, wherein the control unit sets the registration roller pair to the press-contact state after a trailing edge of the conveyed sheet has passed through the nip portion of the registration roller pair.

3. The sheet conveyance apparatus according to claim 1, wherein the control unit stops the driving of the conveyance roller pair so that a downstream end portion of the sheet in the conveying direction stops at the stop position near the nip portion of the registration roller pair.

4. The sheet conveyance apparatus according to claim 1, wherein the control unit controls the registration roller pair such that an operation of setting the registration roller pair to the press-contact state is started before a trailing edge of the conveyed sheet passes through the nip portion of the separated registration roller pair, and the registration roller pair is set to the press-contact state after the trailing edge of the sheet has passed through the nip portion of the registration roller pair.

5. The sheet conveyance apparatus according to claim 1, wherein the control unit stops the driving of the conveyance roller pair so that, when the conveyed sheet is not skewed, a downstream end portion of the sheet conveyed by the conveyance roller pair stops upstream of the nip portion of the registration roller pair.

6. The sheet conveyance apparatus according to claim 1, wherein the control unit rotates the registration roller pair backward after the separated registration roller pair has been set to the press-contact state.

7. The sheet conveyance apparatus according to claim 1, wherein the control unit starts backward rotation of the registration roller pair before an operation of setting the separated registration roller pair to the press-contact state is completed.

8. The sheet conveyance apparatus according to claim 1, wherein the control unit simultaneously carries out forward rotation of the first conveyance roller pair and backward rotation of the registration roller pair after the registration roller pair has been set to the press-contact state.

9. The sheet conveyance apparatus according to claim 1, further comprising:

a width-direction correction unit configured to correct a position of the sheet nipped by the registration roller pair in a width direction by moving the registration roller pair in the width direction orthogonal to the conveying direction of the sheet; and a width-direction correction unit driving unit configured to drive the width-direction correction unit, wherein the control unit carries out an operation of returning the registration roller pair moved by the width-direction correction unit to a home position while the registration roller pair is set in the separated state by the separation and press-contact unit.

10. The sheet conveyance apparatus according to claim 1, wherein the control unit forms the loop in the sheet between the nip portion of the conveyance roller pair and the nip portion of the registration roller pair by rotating the registration roller pair backward and the conveyance roller pair forward, and then conveys the sheet downstream in the conveying direction by rotating the conveyance roller pair and the registration roller pair forward.

11. The sheet conveyance apparatus according to claim 1, wherein the control unit sets a speed at which the conveyance roller pair and the registration roller pair convey the sheet after the loop in the sheet has been formed faster than a speed at which the conveyance roller pair and the registration roller pair convey the sheet when the loop is to be formed in the sheet.

12. The sheet conveyance apparatus according to claim 1, further comprising:

a detection unit disposed upstream of the nip portion of the registration roller pair and configured to detect a downstream end portion of the sheet conveyed by the conveyance roller pair, wherein, after the detection unit has detected the conveyed sheet, the control unit stops the driving of the conveyance roller pair based on a result of the detection.

13. An image forming apparatus comprising:

the sheet conveyance apparatus according to claim 1; and an image forming unit configured to form an image on a sheet conveyed by the sheet conveyance apparatus.

* * * * *